United States Patent [19]

Watanabe et al.

[11] Patent Number: 4,644,110

[45] Date of Patent: Feb. 17, 1987

[54] DIP SWITCH HAVING SINGLE TERMINAL-CONTACT SUPPORT WAFER

[75] Inventors: Hironobu Watanabe, Furukawa; Akira Sakai, Miyagi, both of Japan

[73] Assignee: Alpine Electronics Inc., Japan

[21] Appl. No.: 761,045

[22] Filed: Jul. 31, 1985

[30] Foreign Application Priority Data

Aug. 1, 1984 [JP] Japan ..... 59-117154[U]

[51] Int. Cl.[4] ..... H01H 19/08

[52] U.S. Cl. ..... 200/5 R; 200/6 B; 200/6 BB

[58] Field of Search ..... 200/5 R, 6 R, 6 B, 6 BA, 200/6 BB, 6 C, 16 R, 333

[56] References Cited

U.S. PATENT DOCUMENTS

| | | | |
|---|---|---|---|
| 3,784,765 | 1/1974 | Daly | 200/5 R |
| 3,849,610 | 11/1974 | Lockard et al. | 200/5 R |
| 3,944,760 | 3/1976 | Zdangs et al. | 200/6 BB |
| 4,119,823 | 10/1978 | Matsueda et al. | 200/6 R X |
| 4,389,549 | 6/1983 | Brown | 200/6 BB X |
| 4,497,983 | 2/1985 | Galloway et al. | 200/5 R |

*Primary Examiner*—J. R. Scott

*Attorney, Agent, or Firm*—Guy W. Shoup

[57] ABSTRACT

A dual in-line package (DIP) switch includes movable terminals and fixed terminals all of which are inserted in a wafer by insert molding. The two rows of terminals have terminal portions including contact portions. The terminal portions of the two rows are disposed substantially parallel to each other and spaced apart a given distance within a casing in such a way that the corresponding contact portions can either make or break contact with each other.

3 Claims, 17 Drawing Figures

DIP SWITCH HAVING SINGLE TERMINAL-CONTACT SUPPORT WAFER

FIELD OF THE INVENTION

The present invention relates to a dual in-line package switch having two rows of terminals.

BACKGROUND OF THE INVENTION

A conventional DIP (dual in-line package) switch is shown in FIGS. 11, 12(A) and 12(B), where the switch comprises movable terminals 1, fixed terminals 2, a wafer 3, a casing 4 mounted to the wafer 3, and levers 5 pivotally mounted to the casing 4 by means of a shaft 5*d*. Each movable terminal 1 consists of a portion 1*a* to which solder is to be applied, a portion 1*b* for producing a clicking operation, and a contact portion 1*c*. Each fixed terminal 2 consists of a portion 2*a* to which solder is applied and a contact portion 2*b*. After molding the wafer 3, the terminals 1 and 2 are mounted in the assembly and tightened during assembly operation. Adhesive is then applied to the terminals 1 and 2 and dried to provide intermediate parts. Each lever 5 has an operation portion 5*a* and actuating portions 5*b* and *5c*.

The condition in which the levers 5 are not actuated is shown in FIG. 12(A). Under this condition, if the operation portion 5*a* of each lever 5 is depressed, the actuating portion 5*b* rides over the portion 1*b* of the corresponding movable contact 1 and pushes the contact portion 1*c*. Then, the contact portion 1*c* of the movable terminal is made contact with the contact portion 2*b* of the fixed terminal 2 , and the lever 5 is maintained depressed in that position, as shown in FIG. 12(B).

Under this condition, if the operation portion 5*a* of each lever 5 is pushed upward, the actuating portion 5*b* is caused to ride over the portion 1*b* of the movable terminal 1 by means of this upward force plus the resilience of the terminal 1 itself. Finally, it is restored to the condition shown in FIG. 12(A), where each two corresponding contact portions are not in contact with each other.

Switches as constructed in this way might be cleansed for each printed circuit board after being installed on such boards. Therefore, tape is stuck to windows 4*a* of the casing 4 through which the operation portions 5*a* of the levers 5 protrude. Unfortunately, in this prior art switch, adhesive used to bond the terminals 1 and 2 and adhesive used to bond the casing 4 to the wafer 3 sometimes flow onto the portions 1*a* and 2*a* to be later soldered, making the soldering operation unfeasible. In bonding the terminals 1 and 2 to the wafer 3, these terminals 1 and 2 tend to tilt. If tilted, contact may not be made at the intended position. Further, the contact pressure may deviate from the intended value and vary among finished products.

Another conventional DIP (dual in-line package) switch is shown in FIGS. 13, 14(A), and 14(B). This switch is comprised of movable terminals 6, fixed terminals 7, a first wafer 8*a*, a second wafer 8*b*, a casing 9 mounted on the wafers 8*a* and 8*b*, levers 11, and actuating portions 10 formed integrally with the respective levers 11. Each movable contact 6 is composed of portion 6*a* to which solder is to be applied and a contact portion 6*b* for producing a clicking operation when a contact is made. Each fixed terminal 7 has a portion 7*a* to which solder is to be applied and a contact portion 7*b*. The movable terminals 6 are inserted in the molded wafer 8*a*. Similarly, the fixed terminals 7 are incorporated in the molded second wafer 8*b*. The wafer 8*a* is provided with a protrusion $8a_1$ that is fitted into a recess $8b_1$ in the wafer 8*b*, and both wafers are bonded together with adhesive. The levers 11 has operation portions 11*a* which protrude outwardly through windows 9*a* in the casing 9. When the switch is cleansed, tape is stuck to the windows 9*a* in the same manner as the foregoing switch.

FIG. 14(A) shows the condition in which the contact portion 6*b* in each movable terminal 6 is fitted in a recess 10*a* formed in each actuating portion 10 and in which the actuating portions 10 urge the respective movable terminals 6 downwardly, disengaging the terminals 6 and 7 from each other. Under this condition, if the operating portions of the levers 11 are moved to the left, the contact portions 6 disengage from the respective recesses 10*a* in the actuating portions 10. Then, the movable terminals 6 are returned upward by their own resilience, so that the contact portions 6*b* of the movable terminals 6 come into engagement with the respective contact portions 7*b* of the fixed terminals 7.

In the prior art switch described just above, adhesive used to bond together the fitted wafers 8*a* and 8*b* and adhesive used to bond the wafers 8*a* and 8*b* to the casing 9 may flow onto the portions 6*a* and 7*a* to be soldered later, thereby making the soldering operation impossible. Also, an error arises inevitably in fitting the wafer 8*a* into the wafer 8*b*. Thus, contacts are made in incorrect positions, and the contact pressure deviates from the intended value. In this way, difficulties are encountered in the same fashion as in the above-mentioned conventional switch.

SUMMARY OF THE INVENTION

It is a general object of the present invention to provide a DIP switch which is free of the foregoing difficulties with the prior art switches.

It is a more specific object of the invention to provide a DIP switch which can be assembled with a predetermined contact pressure and predetermined contact positions and which eliminates the possibility that adhesive adheres to soldered portions of movable and fixed terminals during assembly operation.

The above objects are achieved by a switch comprising: movable and fixed terminals formed integrally with the bottom of a wafer by insert molding; a casing; and terminal portions having contact portions that are arranged in the casing, the terminal portions of the two rows being spaced apart a given distance in a parallel relation such that each two corresponding contact portions can either make or break contact with each other to avoid adhesion of adhesive to the soldered portions of the movable and fixed terminals, as well as to permit the terminals to be located precisely and the contact pressure to be established precisely.

BRIEF DESCRIPTION OF THE DRAWIGNS

FIG. 1 is an exploded perspective view partially in cross section of a DIP switch according to the present invention;

FIGS. 2(A) and 2(B) are cross-sectional views of the switch of FIG. 1, for illustrating the operation;

Figure 11:
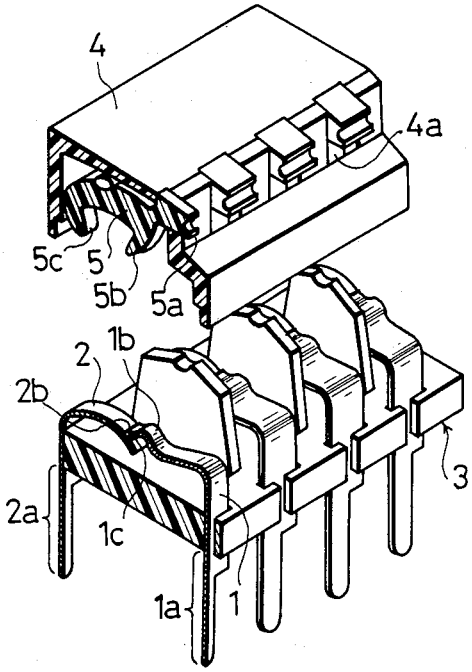
Fig.11 PRIOR ART
FIG. 11 is a side elevation partially in longitudinal cross section of a conventional DIP switch.
Figure 12A:
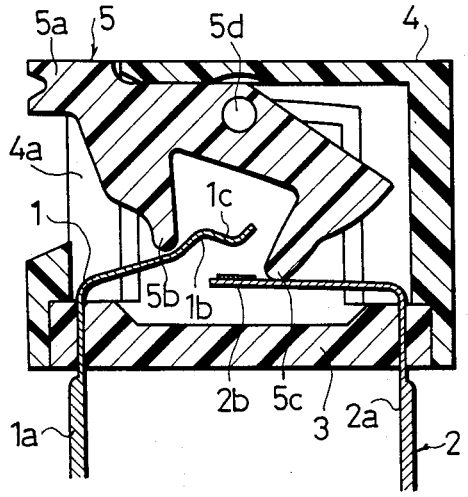
Fig.12(A) PRIOR ART
Figure 12B:
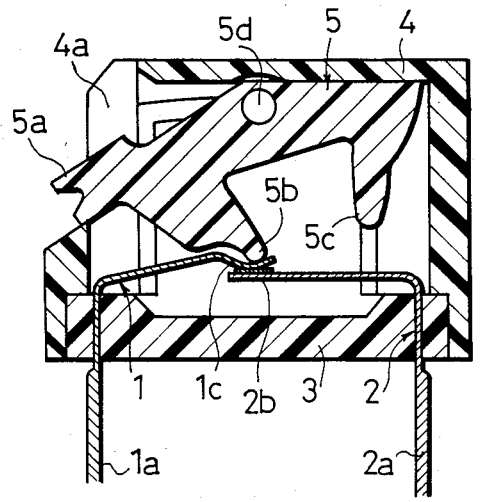
Fig.12(B) PRIOR ART
Figure 13:
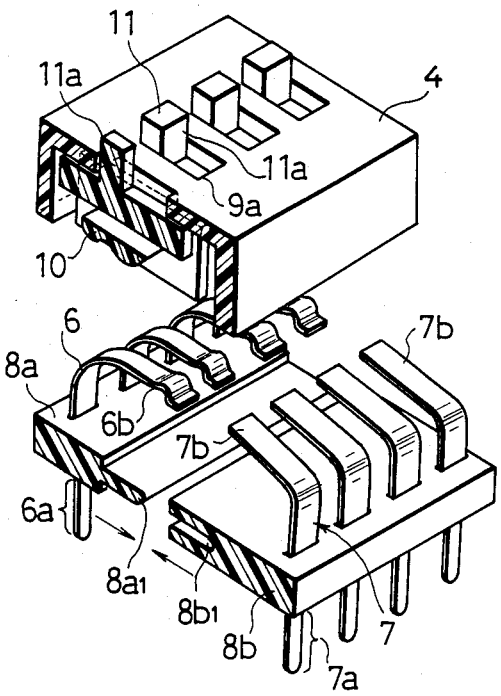
Fig.13 PRIOR ART
Figure 14A:
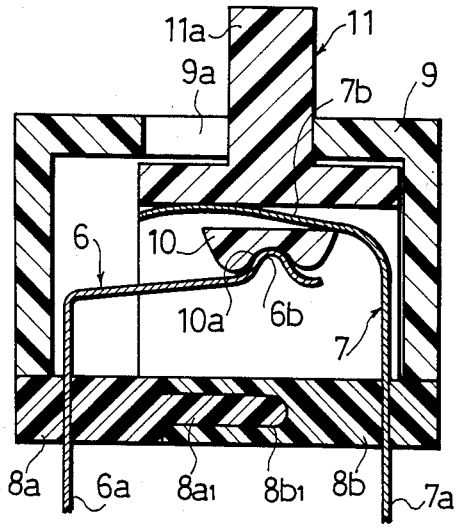
Fig.14(A) PRIOR ART
Figure 14B:
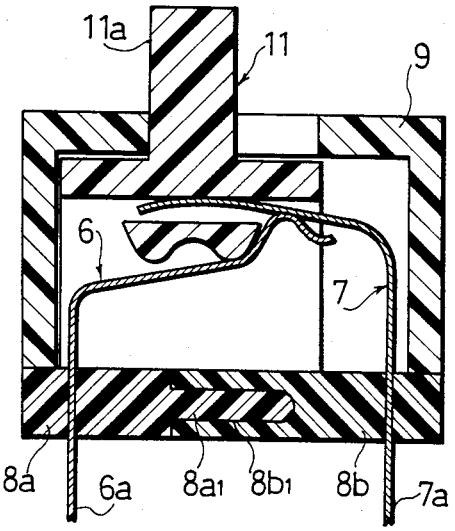
Fig.14(B) PRIOR ART

FIG. 12 (A) and 12(B) are cross-sectional views of the switch of FIG. 11, for illustrating the operation;

FIG. 13 is a perspective view partially in longitudinai cross section of another conventional DIP switch;

FIGS. 14(A) and 14(B) are cross-sectional views of the switch of FIG. 13, for illustrating the operation.

DETAILED DESCRIPTION OF THE INVENTION

Figure 1:
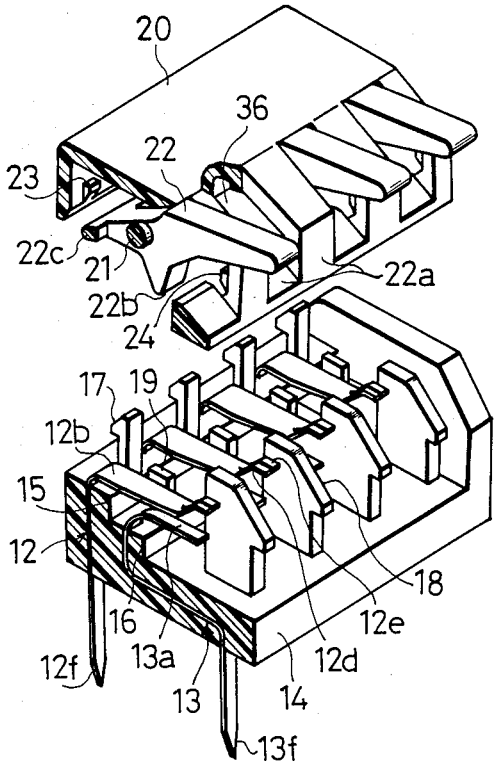

Referring to FIGS. 1, 2(A), and 2(B), there is shown a DIP switch embodying the concept of the present invention. This switch comprises movable terminals 12, fixed terminals 13, a wafer 14, a casing 20 mounted on the wafer 14, a support rod 21 extending above the casing 20, levers 22 pivotally mounted to the rod 21.

Each movable terminal 12 consists of a mounted portion 12*a* and a terminal portion 12*b*. Formed at the front end of the terminal portion 12*b* are a contact portion 12*c*, a portion 12*d* for producing a clicking operation, and a recess 12*e*. Solder is applied to a portion 12*f* lying at the front end of the mounted portion 12*a*. Each fixed terminal 13 is composed of a terminal portion 13*a* and a portion 13*c* at which the terminal is mounted. The terminal portion 13*a* has a contact portion 13*b*. The mounted portion 13*c* consists of a vertical portion 13*d*, a horizontal portion 13*e*, and a portion 13*f* depending vertically from the horizontal portion 13*e* and to which solder is to be applied. The vertical portion 13*d* and the horizontal portion 13*e* are imbedded in the wafer 14.

Figure 2:
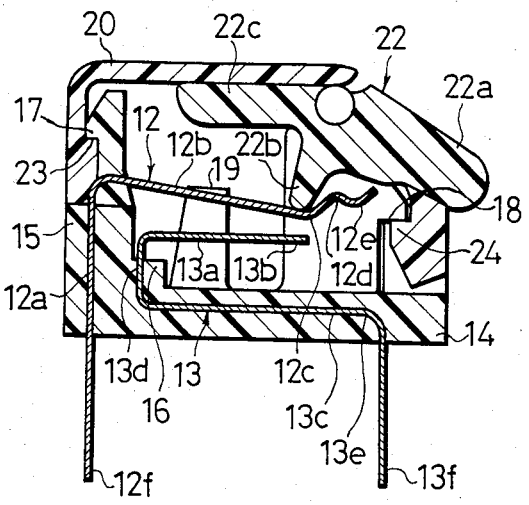
Figure 2:
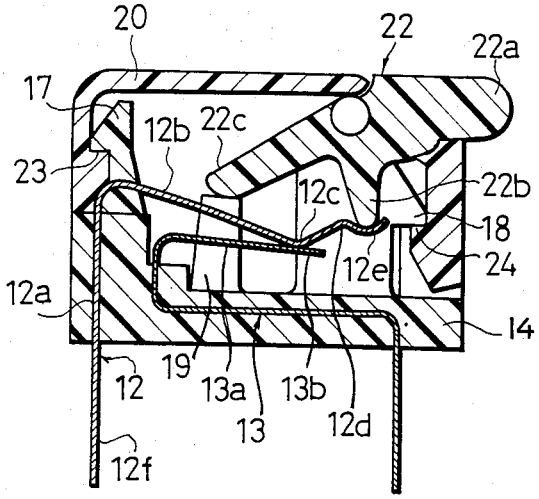

The wafer 14 has an upper step portion 15 and a step portion 16 formed below the upper step portion 15. The wafer 14 is molded in such a way that the mounted portion 12*a* of each movable terminal 12 is inserted in the upper step portion 15 and that the vertical portion 13*d*, the horizontal portion 13*e*, and a portion of the soldered portion 13*f* of each fixed terminal 13 are inserted in the lower step portion 16. The terminal portions 12*b* of the terminals 12 are placed substantially parallel to their respective terminal portions 13*a* of the terminals 13. The corresponding contact portions 12*c* and 13*b* are spaced apart a given distance so that they can either make or break contact with each other. The wafer 14 is provided with mating portions 17 and 18 extending vertically upwardly from the body of the wafer so that the casing 20 can snap into the wafer 14. Each of the levers 22 consists of an operation portion 22*a*, an actuating portion 22*b*, and an arm 22*c*. The casing 20 is provided with mating portions 23 and 24. When the casing 20 is mounted to the wafer 14, the mating portions 17 and 18 of the wafer 14 are brought into engagement with the mating portions 23 and 24 of the casing 20, and the casing 20 snaps into the wafer 14, as shown in FIG. 2. The casing 20 is formed with openings 36 through which the levers 22 protrude.

The manner in which the wafer 14 is molded and the movable terminals 12 and the fixed terminals 13 that are inserted in the wafer are bent and cut is now described.

Figure 4:
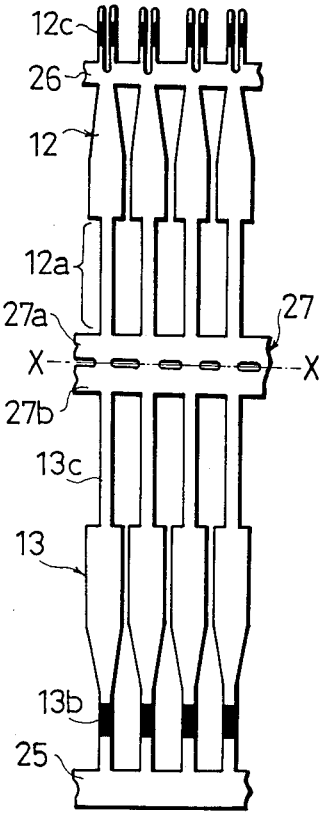
FIG. 4 is a plan view of the switch of FIG. 1, for showing the condition in which the movable and fixed terminals are being machined.
Figure 5:
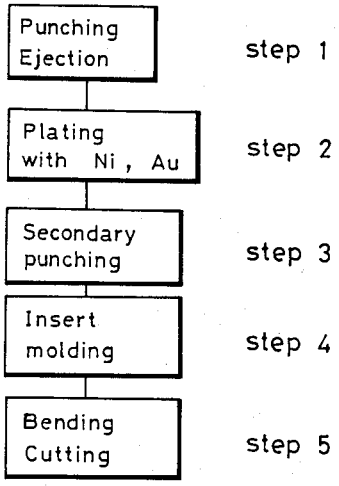
FIG. 5 is a flowchart showing steps for fabricating movable and fixed terminals within a wafer by insert molding.
Figure 6:
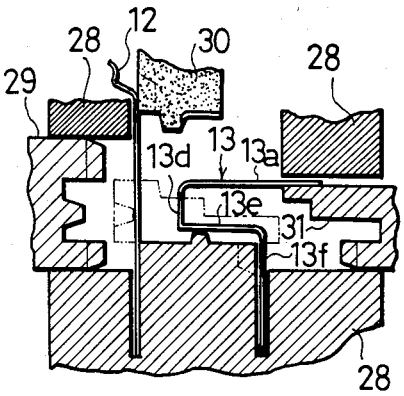
FIGS. 6 and 7 are cross-sectional views of molds for insert molding.
Figure 7:
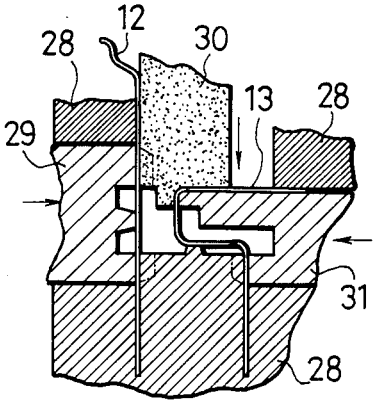

First, an elastic metal sheet is subjected to a primary operation, i.e., punching and ejection, using press tools to form the movable terminals 12 and the fixed terminals 13 in the metal sheet, as shown in FIG. 4 (first step). Then, a secondary operation is carried out. Specifically, the contact portions 12*c* of the movable terminals 12 and the contact portions 13*b* of the fixed terminals 13 are plated with nickel and silver (second step). Then, a portion 25 that connects together the fixed terminals and a portion 26 that connects together the movable terminals are cut. The front ends of the movable contacts 12 and of the fixed terminals 13 are divided from each other. Each fixed terminal 13 is bent into the terminal portion 13*a*, the vertical portion 13*d*, the horizontal portion 13*e*, and the portion 13*f* to be soldered, as shown in FIG. 6. Further, a portion 27 that connects together the movable terminals 12 and the fixed terminals 13 is cut along line X—X to separate the terminals 12 and 13 from each other. Under this condition, the bases of the movable terminals 12 are connected together by a connecting portion 27*a*, and the bases of the fixed terminals 13 are connected together by a connecting portion 27*b* (third step). Then, the movable terminals 12 and the fixed terminals 13 are placed in a mold used for an injection molding, as shown in FIG. 6. This mold is shown to consist of a fixed mold 28 and movable molds 29, 30, 31. Thereafter, the movable molds 29–31 are moved in the directions indicated by the arrows in FIG. 7 to form a space for carrying out an injection molding. Thus, the terminals 12 and 13 are inserted in the molded wafer 14 (fourth step).

Figure 8:
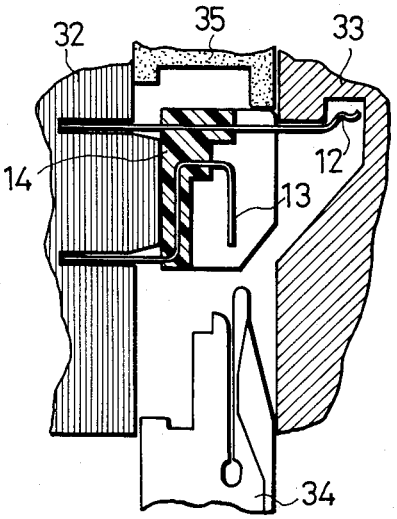
FIGS. 8–10 are cross-sectional views of bender molds.
Figure 9:
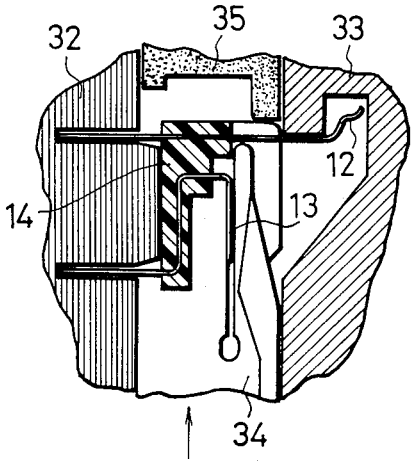
Figure 10:
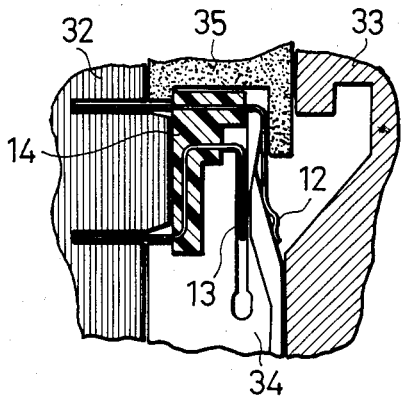

Then, the wafer 14 is placed in a bender mold as shown in FIG. 8. This mold comprises fixed molds 32 and 33. Also shown are a die 34 and a punch 35. First, after setting the wafer 14 in the bender mold, the die 34 is elevated and placed as shown in FIG. 9. Finally, the punch 35 is moved down, as shown in FIG. 10, to bend the movable terminals 12. Subsequently, the portion 27*a* connecting together the movable terminals 12 is cut off. Also, the portion 27*b* connecting together the fixed terminals 13 is cut off (fifth step). In this way, the movable terminals 12 and the fixed terminals 13 are imbedded in the wafer 14, and the cutting operation is completed.

The manner in which the switch constructed as described above operates is next described by referring to FIGS. 2(A) and 2(B). FIG. 2 (A) shows the condition in which the movable terminals 12 are not in contact with the fixed terminals 13. Under this condition, the arm 22*c* of each lever 22 engages with the casing 20, and the actuating portion 22*b* lightly bears on the contact portion 12*c*. If the operation portion 22*a* of each lever 22 is raised until the arm 22*c* comes into engagement with the corresponding stopper 19, then the actuating portion 22*b* will ride over the portion 12*d* for producing a clicking operation and fit into the recess 12*e* at the front end. Then, the movable terminals 12 are depressed by the actuating portions 22*b* of the levers. This brings the contact portions 12*c* of the movable terminals 12 into contact with the contact portions 13*b* of the fixed terminals 13, as shown in FIG. 2(B). Thus, the movable terminals are electrically connected with the fixed terminals. In this state, if the operation portions 22*a* of the levers 22 are pressed downwardly, the actuating portions 22*b* will ride over the portions 12*d* and return to the position shown in FIG. 2(A). Then, the movable terminals 12 are restored to the upper position by their own resilience. Hence, the contact portions 12*c* of the movable terminals 12 break contact with the contact portions 13*c* of the fixed terminals 13, as shown in FIG. 2(A).

Figure 3:
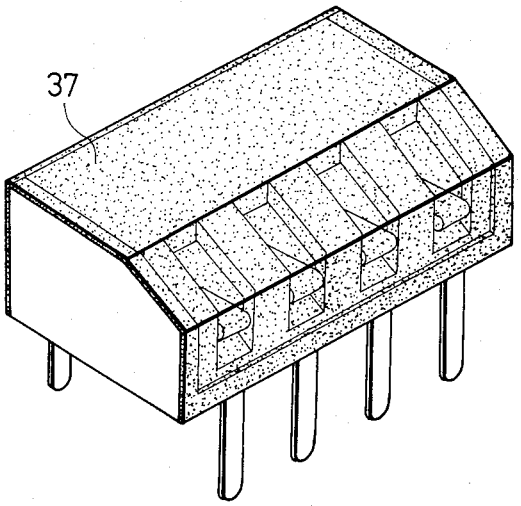
FIG. 3 is a perspective view of the switch of FIG. 1, and in which tape has been stuck to the upper surface, including the front surface, of the switch for sealing purposes.

The DIP switch according to the invention has the structure as described above. The casing 20 is held to the wafer 14 by causing the mating portions 23 and 24 to snap into the mating portions 17 and 18. This creates a closed assembly. If the switch is cleansed together with a printed circuit board after the switch has been installed on the board, a closed condition is established only by covering the upper surface, including the front surface, with tape 37 as shown in FIG. 3 after the switch has been assembled. The terminals 12 and 13 are formed integrally with the wafer 14 and so adhesive is not applied to the terminals, unlike the first-mentioned prior art switch. Therefore, the portions 12*f* and 13*f* of the terminals 12 and 13 can easily be soldered to conductive foils of a printed circuit board.

Another advantage arises from the fact that the fixed terminals 13 are shaped after they have been placed in predetermined positions. Namely, the accuracy obtained depends on the mold used. Also, since the movable terminals 12 are bent after the terminals 12 have been fixedly inserted in the wafer 14, the dimensions of the terminals 12 can readily be determined with accuracy. Consequently, the terminals 12 and 13 can be positioned precisely. Further, the contact pressure can be set precisely. In addition, since the opposite terminal portions 12*b* and 13*a* of the terminals 12 and 13 extend in one direction such that their free ends are aligned in line, the movable portions of the terminal portions 12*b* and 13*a* can be made sufficiently long, so that the contact portions 12*c* and 13*b* of the terminals 12 and 13 can maintain their resilience over a long term.

As can be understood from the description thus far made, according to the invention, the fixed terminals are rendered fixed while placed in position. The movable terminals are fixedly inserted in the molded wafer and then they are bent. Hence, the accuracy with which they are located and the contact pressure can be determined precisely. The terminal portions of the movable and fixed terminals are disposed substantially in parallel relation such that their free ends lie in line. Accordingly, the movable portions of the movable and fixed terminals can be made sufficiently long, in which case the terminals can exhibit their resilience over a long period. Furthermore, it is unlikely that adhesive flows onto the soldered portions of the movable and fixed terminals. This facilitates soldering the switch to a printed circuit board.

What is claimed is:

1. A DIP switch comprising:

a single wafer body molded as one piece having a row of movable terminals spaced apart from a row of fixed terminals with both rows molded fixedly in a bottom portion of said single wafer body, said movable and fixed terminals each having integrally an external portion, an intermediate portion, and a contact portion, said external portion extending externally from the bottom portion of said wafer, said intermediate portion fixedly molded in said wafer, and said contact portion extending into an internal space defined in said wafer on one side of said wafer, wherein the respective free ends of said contact portions of said movable terminals and of said fixed terminals extend substantially parallel to each other in the same direction toward an opposite side of said wafer and terminate in proximity to said opposite side, said contact portions of said movable terminals being spaced a given distance apart from respective contact portions of said fixed terminals so as to be movable into or out of contact therewith;

a casing mounted to said wafer enclosing said internal space of said wafer; and means for individually actuating each of said contact portions of said movable terminals into or out of contact with a respective fixed terminal, said means being mounted in said casing and having respective operable ends thereof extending from said casing.

2. A DIP switch according to claim 1, further comprising respective snap fitting elements fixed to said casing and said wafer body for mounting them together without the use of adhesives.

3. A DIP switch according to claim 1, wherein said movable and fixed terminals have their respective external portions located at opposite sides of said wafer and said intermediate portions of either said movable or fixed terminals being molded in said bottom portion of said wafer extending from said opposite side to said one side of said wafer.

* * * * *